US005199785A

United States Patent [19]

Scholz

[11] Patent Number: 5,199,785

[45] Date of Patent: Apr. 6, 1993

[54] OPERATING THEATRE LAMP

[75] Inventor: Manfred Scholz, Seitingen, Fed. Rep. of Germany

[73] Assignee: Delma elektro-und medizinische Geraetebau Gesellschaft mbH, Tuttlingen, Fed. Rep. of Germany

[21] Appl. No.: 808,488

[22] Filed: Dec. 17, 1991

[30] Foreign Application Priority Data

Dec. 19, 1990 [DE] Fed. Rep. of Germany ... 9017143[U]

[51] Int. Cl.[5] ..... F21V 13/00

[52] U.S. Cl. ..... 362/296; 362/33; 362/293; 362/804

[58] Field of Search ..... 362/33, 263, 264, 293, 362/296, 303, 341, 375, 804, 327, 329, 330

[56] References Cited

U.S. PATENT DOCUMENTS

| | | | |
|---|---|---|---|
| 3,255,342 | 6/1966 | Seitz et al. | 362/33 |
| 3,463,914 | 8/1969 | Lutter | 362/33 |
| 3,609,335 | 9/1971 | Kelly | 362/33 |
| 4,220,982 | 9/1980 | Martino | 362/33 |
| 4,237,523 | 12/1980 | Moote | 362/293 |
| 4,524,410 | 6/1985 | Kawakatsu et al. | 362/293 |
| 4,604,680 | 8/1986 | Levin et al. | 362/293 |
| 4,651,257 | 3/1987 | Gehly | 362/346 |
| 4,994,945 | 2/1991 | O'Shea et al. | 362/293 |
| 5,067,064 | 11/1991 | Gehly et al. | 362/33 |
| 5,093,769 | 3/1992 | Luntsford | 362/293 |

FOREIGN PATENT DOCUMENTS

| | | | |
|---|---|---|---|
| 613476 | 1/1961 | Canada | 362/33 |
| 3807584 | 9/1989 | Fed. Rep. of Germany | 362/260 |
| 2431657 | 3/1980 | France | 362/33 |
| 484416 | 9/1953 | Italy | 362/341 |
| 872586 | 7/1961 | United Kingdom | 362/33 |
| 927676 | 5/1963 | United Kingdom | 362/33 |

*Primary Examiner*—Ira S. Lazarus
*Assistant Examiner*—Y. Quach
*Attorney, Agent, or Firm*—Townsend and Townsend

[57] ABSTRACT

An operating theatre lamp, for lighting a site of an operation from above, comprises at least one light source, followed by a reflector arrangement (3) which concentrates the light beams issuing from the light source on the site of the operation and by at least one infrared filter (41) which absorbs and/or reflects the predominant portion of the thermal radiation, and which preferably also filters out ultraviolet radiation components. The lamp further comprises at least one closure plate (5) which covers over the reflector arrangement (3) from below and is preferably made of a structured glass which irregularly refracts the light, the radiation of the light source (2) being in particular directed in a predetermined solid angle outwardly towards the reflector arrangement (3), the latter deflecting the light beams (20) downwardly onto the closure plate (5) and towards the site of the operation (7). A transparent foil (6a, 6b) is provided on one or on both sides of the closure plate (5) and preferably extends over the entire surface of the closure plate (5), and at least one foil, preferably the foil which is located above the closure plate (5), is realized as a filter which shifts the color location of the light issuing from the IR filter (41) in the direction of white light.

6 Claims, 1 Drawing Sheet

OPERATING THEATRE LAMP

Figure 1:
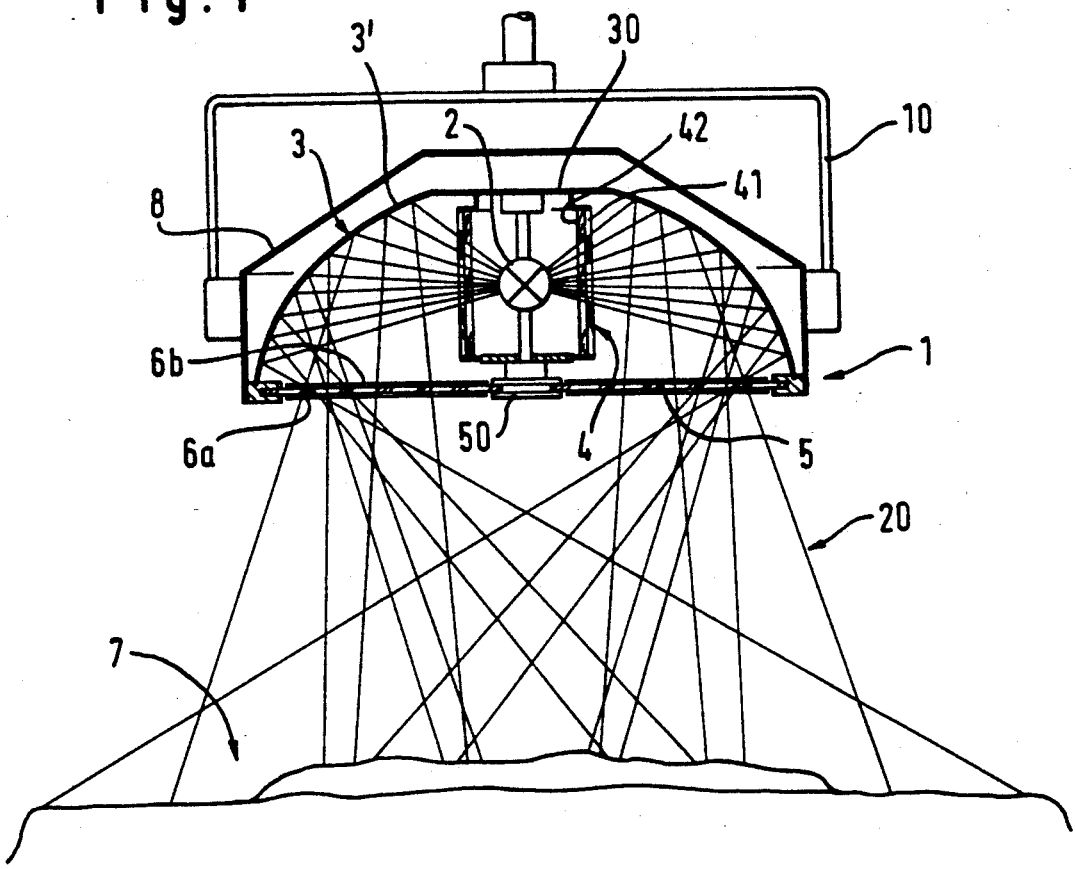

The present invention relates to an operating theatre lamp, for lighting a site of an operation from above, comprising at least one light source, followed by a reflector arrangement which concentrates the light beams issuing from the light source on the site of the operation and by at least one infrared filter which absorbs and/or reflects the predominant portion of the thermal radiation, and which preferably also filters out ultraviolet radiation components, and further comprising at least one closure plate which covers over the reflector arrangement from below, said plate being preferably made of a structured glass which irregularly refracts the light, the radiation of the light source being in particular directed in a predetermined solid angle outwardly towards the reflector arrangement, the latter deflecting the light beams downwardly onto the closure plate and towards the site of the operation.

In order to be able to carry out medical operations exactly and safely, the entire site and in particular the surgical wound must be ideally illuminated. In traditional operating theatre lamps (U.S. Pat. No. 3,255,342; DE-OS-23 05 664; DE-OS-21 39 797; DE-U-77 17 816; AT-PS-113 122) one or several light sources are provided for this purpose, the light of which is influenced by means of filters and of a reflector in such a manner that an appropriate intensity and spectral distribution is achieved over the site of the operation. Usually, such operating theatre lamps comprise a closure plate which covers over the interior of the lamp with the light source, the illumination optics and the filters on the side of the site of the operation.

By means of the illumination optics, which can comprise ring-shaped reflectors, several combined individual reflectors or lens systems, the diverging light is directed to the site of the operation in such a manner as to largely avoid a formation of shadows by the operator and his assistants and also by the instruments they use.

Since operating theatre lamps must on the one hand have a greatest possible illumination intensity and should on the other hand increase the temperature at the site of the operation only as slightly as possible, filters must be provided between the light source and the reflector, which largely absorb the thermal radiation.

An important absorption is problematic since the illumination intensity at the site of the operation can reach 100 000 LUX, which corresponds approximately to the illumination intensity of the sun light at noon in summer. Since during many operations, especially difficult operations such as for example heart operations, the patient must be in fact cooled, it is important to also keep smallest heat quantities as much as possible away from the site of operation. This is only possible with filters which shift the colour location of the filtered light in such a way that it can no longer be spoken of illumination with white light.

The main object of the invention is to realize an operating theatre lamp of the kind mentioned at the beginning, which allows to perfectly keep heat away from the site of operation, owing to a feature of simple construction which does not practically increase the space requirements, without impairing the spectral distribution, corresponding to white light, of the light arriving on the site of operation.

In accordance with the patent, this object is met by the fact that a transparent foil is provided on one or on both sides of the closure plate and preferably extends over the entire surface of the closure plate, and in that at least one foil, preferably the foil which is located above the closure plate, is realised as a filter which shifts the colour location of the light issuing from the IR filter in the direction of white light.

In accordance with the invention, owing to the use of a foil having appropriate filter properties, it is possible to adjust ideally the spectral distribution of the light issuing from the operating theatre lamp in a constructionally simple and space saving manner. It is hereby possible, by means of the filter between the light source and the reflector, to retain largely completely, the IR radiation emitted by the light source, since the disadvantageous spectral shift caused by the latter is corrected by the filter foil(s) of the invention. It is thereby ensured that the site of operation is practically not heated by the operating theatre lamp and simultaneously a bright and ideal white illumination of the site of operation is achieved.

Since the foils are made of plastics, whereas the closure plate is preferably made of mineral glass, the embodiment in which provision is made for only one foil located on the upper face of the closure plate and adhered thereto is particularly preferred, since in this manner, there is above the site of operation mineral glass which is easier to clean and to disinfect, and is further resistent against aggressive cleaning products. A further advantage of this embodiment is that the rest of infrared radiation filtered out or reflected by the filter foil is eliminated before reaching the closure plate.

Figure 2:
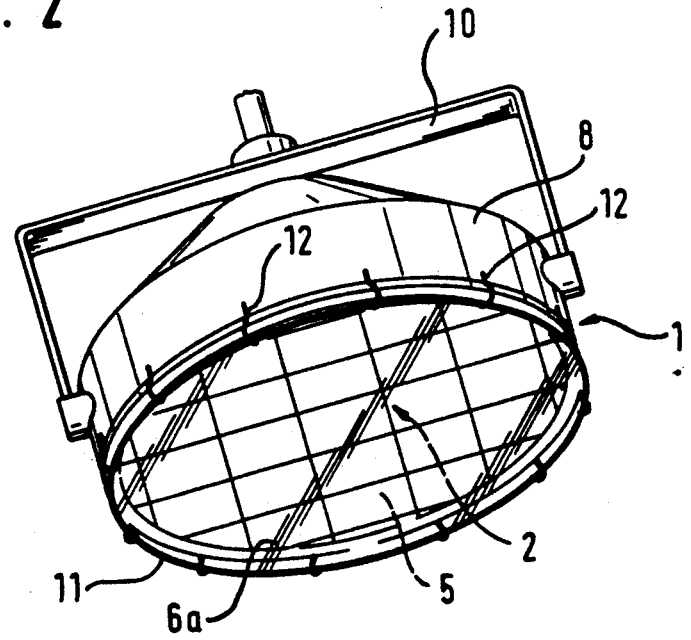

The invention is described in more detail in the following with reference to the drawings; the latter show:

FIG. 1 a cross-section view of an operating theatre lamp having splitter protection filter foils on both sides of the closure plate, and FIG. 2 a perspective view of this operating theatre lamp.

In FIG. 1 is shown an operating theatre lamp 1, the housing 8 of which can be mounted by means of a carrier bracket 10 in an adjustable manner on the ceiling or the wall of an operation room or on a stand. In the centre of the housing 8 is placed a light source 2 which is preferably realized as a halogen or gas discharge lamp for producing a particularly intense light with lower heat dissipation.

A cylindrical filter 4 is arranged concentrically around the light source 2. In order to retain both infrared and ultraviolet radiation, the cylindrical filter 4 comprises an IR filter portion 41 and an UV conversion filter portion 42.

The light beams 20 issuing from the light source 2 arrive after their passage through the cylindrical filter 4 onto a reflector arrangement 3 having the form of a ring portion 3' of a concave mirror. This ring portion can be made in one piece or composed of angle or ring segments. The reflector arrangement 3 can also have the shape of a polygon and comprise several one-piece or composite mirror parts arranged above one another. It is also possible to place together individual flat or curved mirror parts along a spherical or paraboloidal segment surface in order to form the reflector arrangement 3. At its centre the ring portion 3' of the concave mirror is provided with a support plate 30.

The light beams 20 are deflected by the reflector arrangement 3 in such a way that they illuminate a site of operation 7, in which individual light beams 20 converge from different solid angles in each point. Owing to this lighting one is ensured that no portion of the site of operation 7 is inadmissibly strongly darkened by shadow formation on entering the hands of the operator or of his assistants in the radiation path.

The operating theatre lamp 1 further comprises a closure plate 5 which closes downwardly the housing 8. The closure plate 5 is ring-shaped and comprises at its centre an opaque cover plate 50, on the upper side of which is mounted a socket for the light source 2 and mounts for the cylindrical filter 4.

The closure plate 5 is made of structured glass, in order to achieve an irregular direction distribution of the light exiting from the closure plate 5 and thus a light distribution which is as regular as possible in the site of operation 7.

The closure plate 5 is made of one pane safety glass.

On the lower side of the closure plate 5 is adhered a foil 6*a* which covers the entire surface of the closure plate 5.

The foil 6*a* is highly transparent and serves to prevent splitters from falling onto the site of operation 7 if the closure plate 5 breaks.

On the upper side of the closure plate 5 is applied a further foil 6*b* which also entirely covers the closure plate 5 and is realized as a filter.

Thus, by means of the filter foil 6*b*, the colour location of the light passing therethrough is defined in such a way that the colour shifts caused by the IR filter 41 are corrected or the desired spectral distribution of the light illuminating the site of operation 7 is established.

It is also possible to realize the filter foil 6*b* as a conversion foil which converts the UV radiation into visible light. This is in particular necessary or useful when the cylindrical filter 4 does not retain UV radiation to the desired extent or does not retain it at all, and does not comprise itself a conversion filter portion.

The foil 6*a* and filter foil 6*b* are adhered to the closure plate 5, which can be realized particularly simply and in a defined manner. However, it is also possible to stretch the foil, in particular the lower foil 6*a*, in a frame 11 surrounding the closure plate 5 or in a special frame which is mounted on the housing 8 below the closure plate 5 by means of supports 12 as shown for example in FIG. 2.

In addition, the foil 6*a* and filter foil 6*b* can be applied on the closure plate 5 for example by spraying or in a dipping bath. It is also possible to use thicker foils which are fixed on the operating theatre lamp 1 by means of appropriate holding means and can thus be also easily replaced.

A preferred realization of the invention comprises a single foil 6*b* which is adhered above onto the closure plate 5 and is realized both as a splitter protection and also as a filter. If the combined splitter protection filter foil 6*a* is applied below on the closure plate, it is expediently replaceable.

In accordance with the invention, the foil 6*a* and filter foil 6*b* can comprise an interference filter coating, which reflects infrared components of the incident light and also components thereof in the visible range in the interior of the operating theatre lamp, in such a way that the spectral range of the transmitted light is shifted in the direction of white light.

Further, when the foil or foils are adhered to the closure plate, they are preferably removable.

I claim:

1. Operating theatre lamp, for lighting a site of an operation from above, comprising:

at least one light source providing a plurality of light beams directed in a predetermined solid angle outwardly towards a reflector arrangement which concentrates the plurality of light beams issuing from the at least one light source downwardly towards the site of the operation;

at least one infrared filter located between the light source and the reflector arrangement which absorbs a predominant portion of an infrared radiation component of the plurality of light beams;

at least one closure plate which covers the reflector arrangement from below receiving light beams reflected by the reflector arrangement downwardly towards the site of the operation, said at least one closure plate being made of a structured glass which irregularly refracts the plurality of light beams; and a transparent foil adhered to an upper surface of the at least closure plate extending substantially over the entire upper surface of the at least one closure plate and reflecting an ultraviolet radiation component of the plurality of light beams;

whereby the adhesion of the transparent foil to the at least one closure plate prevents glass particles from falling onto the site of the operation when the at least one closure plate breaks.

2. Operating theatre lamp according to claim 1, wherein the transparent foil comprises an interference filter coating which reflects an infrared component of the plurality of light beams and shifts a spectral range of the plurality of light beams such that a transmitted light exits the interference filter coating with a spectral range closer to a white light than the plurality of light beams.

3. Operating theatre lamp according to claim 2 wherein the at least one infrared filter absorbs the infrared component of the plurality of light beams that has been reflected from the interference filter coating.

4. Operating theatre lamp according to claim 1 further comprising an ultraviolet filter positioned between the at least one light source and the reflector arrangement for removing the ultraviolet radiation component from the light plurality of beams.

5. Operating theatre lamp according to claim 4 wherein the ultraviolet filter absorbs the ultraviolet radiation component of the plurality of light beams that has been reflected from the transparent foil.

6. Operating theatre lamp according to claim 1 wherein the at least one closure plate is made of one-pane safety glass.

* * * * *